United States Patent [19]

Kamioka et al.

[11] 4,380,104

[45] Apr. 19, 1983

[54] APPARATUS FOR SEPARATING THE FILAMENT BUNDLE OF FIBROUS MATERIAL

[76] Inventors: Seiichi Kamioka, 390-5, Shimonogo-cho, Moriyama-shi, Shiga-ken; Masahiko Manabe, B3-22,10, Sonoyama 2-chome; Rokuro Sakai, 4-25-1, Sonoyama 2-chome, both of Ohtsu-shi, Shiga-ken, all of Japan

[21] Appl. No.: 225,740

[22] Filed: Jan. 16, 1981

[30] Foreign Application Priority Data

Jan. 18, 1980 [JP] Japan ..... 55-3599

[51] Int. Cl.[3] ..... D01D 11/02

[52] U.S. Cl. ..... 28/282; 19/299; 28/254

[58] Field of Search ..... 264/22; 425/174.8 E; 19/299; 28/282, 254

[56] References Cited

U.S. PATENT DOCUMENTS

| | | | |
|---|---|---|---|
| 2,108,361 | 2/1938 | Asakawa | 425/174.8 E |
| 2,336,745 | 12/1943 | Manning | 425/174.8 E |
| 3,384,944 | 5/1968 | Medeivos et al. | 28/282 |
| 3,506,744 | 4/1970 | Talbert | 264/22 |
| 3,657,871 | 4/1972 | Uchiyana et al. | 28/282 |
| 3,708,561 | 1/1973 | Horimoto et al. | 264/22 |
| 3,853,651 | 12/1974 | Porfe | 156/167 |
| 3,967,118 | 6/1976 | Sterberg | 28/254 |
| 4,009,508 | 3/1977 | Sterberg | 19/299 |
| 4,089,720 | 5/1978 | Haley | 156/167 |
| 4,148,595 | 4/1979 | Benduary | 425/174.8 E |
| 4,233,014 | 11/1980 | Kinney | 425/174.8 E |

*Primary Examiner*—Jay H. Woo

[57] ABSTRACT

A fibrous material composed of multifilaments is forced out of a spinneret with a fluid to collide with an impingement plate thereby separating the filaments, said impingement plate having as its impinging surface a material which creates a negative electrical charge on the surfaces of the filaments of the fibrous material upon impingement. This greatly improves separation of the filaments and permits production of non-woven sheets with high uniformity.

11 Claims, 9 Drawing Figures

APPARATUS FOR SEPARATING THE FILAMENT BUNDLE OF FIBROUS MATERIAL

BACKGROUND

This invention relates to an apparatus for separating filaments of a continuous multifilament bundle.

In a bundle composed of a multiplicity of individual filaments, it is often desirable that the filaments be separated from each other so that the bundle is in an optimum condition for further processing. Therefore, a variety of methods have been utilized to effect the separation of the filaments. The conventional separation techniques may be divided into three primary types: the bundle is charged electrostatically; the filaments are separated in a running fluid; or the bundle is mechanically impacted on an impingement plate.

The technique used is selected based on the properties of the bundle. Preference is generally given to a technique which is simple in implementation, low in equipment cost and high in operating performance.

It has been found that the separation technique comprising running the continuous filaments against an impingement plate is best suited for the separation of the filaments of a multifilament bundle of the type contemplated in the present invention. As a technique for separating the filaments of a multifilament bundle by impacting against an impingement plate, U.S. Pat. No. 3,169,899 shows a method in which filaments discharged from a spinning nozzle are impacted against a vibrating V-shaped trough to form a broad non-woven sheet of filaments on a net. To achieve a high degree of uniformity in the non-woven sheet, good separation of the filaments is required.

The method described in the above-cited patent, involving filament separation by impingement of the multifilament bundle against an impingement plate, is simple with respect to the equipment required and is superior in operating performance, but does not produce sufficient filament separation for further processing the bundle into a non-woven sheet of high uniformity.

An important object of this invention, therefore, is to improve the separation of the filaments of the multifilament bundle to such an extent that a non-woven sheet having a high degree of uniformity can be produced.

SUMMARY OF THE INVENTION

The present invention is intended to attain this object and to this end it provides an apparatus for separating the filaments of a continuous multifilament bundle by forcing the multifilament bundle out of a nozzle against an impingement plate whose impinging surface is made of a material which produces a negative electrical charge on the surface of the filaments upon impingement.

BRIEF DESCRIPTION OF THE DRAWINGS

FIGS. 1 and 2 show a process and an apparatus for producing a bundle with highly separated filaments and for producing a uniform non-woven sheet as well.

FIG. 3 shows a process for producing separated filaments and a non-woven sheet from a fibrous bundle which had been wound after spinning.

FIG. 4 shows a flat plate-shaped impingement plate;

FIG. 5 shows an impingement plate incorporated in a tube;

FIG. 6 shows a box-like impingement plate having side walls, and

FIG. 7 shows an impingement plate bonded to a base plate.

DETAILED DESCRIPTION OF THE PREFERRED EMBODIMENTS

Figure 1:
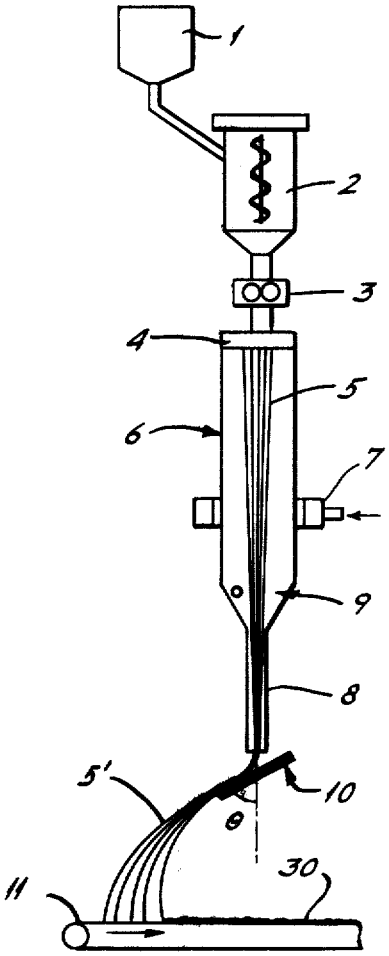
FIGS. 1 through 3 are diagrammatic illustrations of specific forms of the apparatus used in the practice of this invention.

Although specific terms will be utilized hereinafter in describing the specific forms of the inventions selected for illustration in the drawings, the use of these terms is not intended to define or to limit the scope of the invention which is defined in the appended claims.

Referring to FIG. 1, fiber-forming polymer chips are supplied from a hopper 1 into a melter 2 to form molten polymer. This molten polymer is pumped out by a metering pump 3 and extruded through the orifice plate of a spinneret 4, such plate having a plurality of holes, and the polymer is thus formed into continuous filaments consisting of multifilament bundles 5. The lower part of the spinneret is covered by a cylinder 6, adapted to cool and solidify the filaments 5 extruded from the spinneret 4. Said cylinder 6 and spinneret 4 are sealed from the outer air and a compressed fluid is introduced into the cylinder 6 from an inlet 7 in the peripheral wall thereof, said fluid being forced out with the filaments 5 from a nozzle 8 connected to the tip of the cylinder 6. The filaments 5 are stretched by high-speed fluid in the section between spinneret 4 and nozzle 8. The filaments 5 are ejected with the high-speed fluid from the end opening of the nozzle 8 and are impacted against an impingement plate 10 positioned close to the end opening of nozzle 8, whereby the filaments are separated.

Said impingement plate 10 is set with an angle of inclination $\theta$ against the axis of the nozzle 8. An optional electrification means 9, designed to apply corona discharge or electrification to the filaments before ejection from the nozzle 8, may be added. Such electrification means may also be added to the impingement plate 10 where additional separation of the filaments is required.

To evaluate the degree of filament separation, the separated filaments are dropped onto moving surface of collector means 11 and collected in the form of non-woven sheet 30. Said collector means 11 is preferably an air-permeable endless conveyor belt. It may be made of a material such as metal gauze or the like. It is desirable that an air suction source (not shown) be provided beneath said collector to assist in obtaining stable deposition of the fiber web on collector means 11.

The degree of filament separation may be evaluated by determining the degree of uniformity in the non-woven sheet as determined by the weight per unit area of the non-woven sheets collected on the surface of collector means 11.

Figure 2:
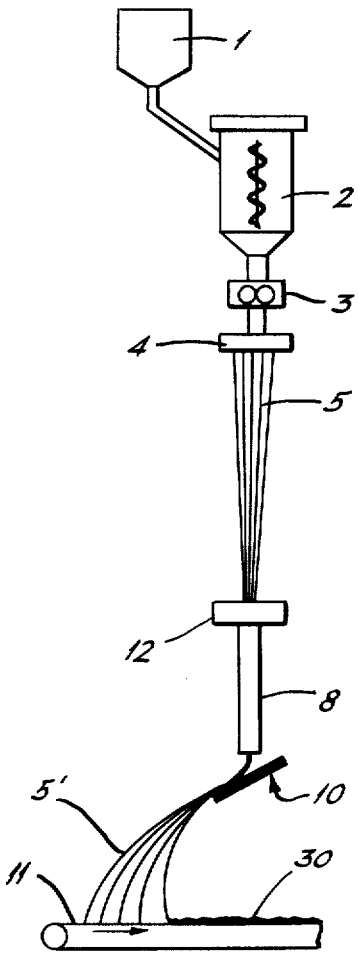

FIG. 2 is a schematic drawing illustrating another embodiment of the filament separation apparatus with the sheet producing process. In this embodiment, the steps preceding spinneret 4 may be the same as in FIG. 1. In the embodiment of FIG. 2 an ejector 12 is used as the fluid drawing device and the spinneret is opened to the atmosphere. The filaments 5, drawn by the ejector 12, are forced out of nozzle 8 in a direction to collide with impingement plate 10. An optional electrification means 9, as shown in FIG. 1, designed to perform corona discharge or electrification of the filaments before ejection from nozzle 8 may be added in the device of FIG. 2 as well. Such electrification means 9 may alternatively be added to the impingement plate 10 where additional separation of the filaments is required. To evaluate the filament separation, the separated filaments are dropped onto and collected in the form of a nonwoven sheet 30 on a moving surface of collector means 11.

Figure 3:
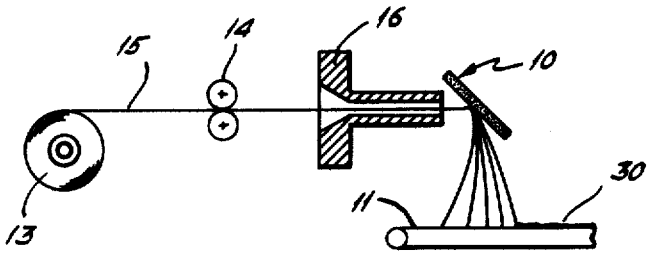

FIG. 3 shows another embodiment of the filament separation process. A continuous multifilament fiber bundle, previously wound in the form of a cheese 13, is run through supply rollers 14 and against the impingement plate 10 under force of an ejector 16, such as a typical air ejector for example, whereby the filaments are separated from one another. The separated filaments are collected as a sheet 30 on surface of collector means 11.

It is an important feature of this invention that the active and effective surface of the impingement plate be made of a material which will cause the surfaces of the filaments to become negatively charged electrically upon impingement to effect separation of the filaments.

Although it is not clear why these phenomena occur, it is believed that in some unexplained way frictional electrification is induced by impingement of the fibrous material against the impinging plate, and that where the fibrous material is negatively charged by such frictional electrification, the electrification is intense enough and stable enough to promote separation of the fibrous material. On the other hand we have observed that if the fibrous material is charged positively the electrification effect is weak and unstable.

It is preferred that a lead-based metal be used for the impinging surface of the impinging plate. This metal may be lead itself or a lead alloy containing at least about 60% by weight of lead, or a metal composed of zinc or zinc oxide, copper, piezoelectric material, silver, aluminum or the like. In the case of a lead alloy containing at least 60% by weight of lead, it is recommended that antimony, indium, tin, silver, copper or the like be used as the other component of the alloy.

For the piezoelectric material, any inorganic or organic type may be used, but it is preferable to use a plate-shaped or columnar PZT ($Pb(Zr, Ti)0_3$)-based ceramic piezoelectric material to obtain excellent piezoelectric characteristics and because of good availability.

The negative electrical charge created on the filaments is measured as "surface potential" for purposes of this invention. The "surface potential" means the surface potential of the filaments of the multifilament fiber just after impingement against the impingement plate measured at a position 30 mm away from the impingement plate by using a Static Charge Meter, Model 2B, Scientific Enterprises, Inc.

When the above-described material is used as the impinging surface of the impingement plate, the filaments of the multifilament bundle are charged negatively upon impingement and the surface potential created is greater than −10 KV, which greatly facilitates separation of the filaments. Where lead, a lead-based alloy or a piezoelectric material is used, a surface potential of more than −18 KV is produced and excellent filament separation occurs.

A few forms of installation of the impingement plate for this apparatus are described with reference to FIGS. 4 through 7 of the drawings.

Figure 4:
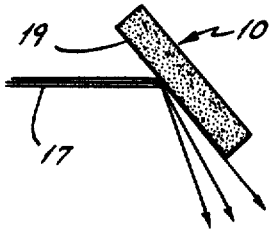
FIGS. 4 through 7 are diagrammatic drawings showing various embodiments of impingement plates according to this invention.

In the embodiment of FIG. 4, the fibrous material 17 moves from left to right and collides with the impinging surface 19 of the impingement plate 10 positioned at an angle to the direction of movement of the fibrous material.

Figure 5:
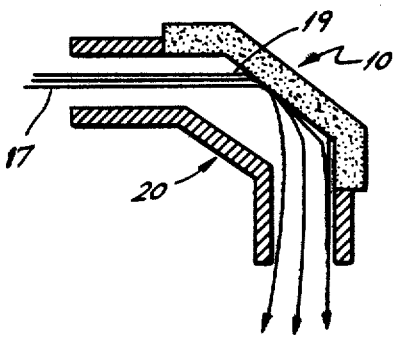

FIG. 5 shows an embodiment in which the impingement plate 10 is incorporated into the inner wall of a tube 20 so that the fibrous material 17 moving in the tube 20 collides with the impingement surface 19 and further moves on in the tube 20 as a separated fibrous material.

Figure 6:
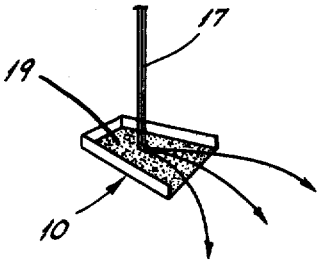

FIG. 6 shows a fan-shaped, box-like impingement plate 10 where the fibrous material 17 collides with the impingement surface 19.

Figure 7:
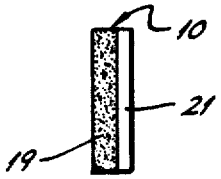

FIG. 7 shows still another embodiment of impingement plate 10. The impingement plates as shown in FIGS. 4 through 6 have their impinging surfaces made of the same material as the body of the plate, whereas the impingement plate of FIG. 7 is constructed by bonding an impingement surface 19 to a base plate 21 made of a different material. The material of the base plate 21 may be either inorganic or organic material. This is limited by the requirement that the material should be able to withstand the impingement impact.

Any suitable material joining method may be used for fabricating the type of impingement plate shown in FIG. 7 of the drawings. For instance, an element forming the impingement surface may be bonded to a base plate or the base plate may be plated to form its impingement surface.

The impingement surface may be joined to the base plate so that the impingement surface alone may be replaced when desired. The impingement plate may be constructed so as to be adjustable so that the point of impact of the fibrous material against the impingement surface may be changed from time to time to minimize wear of the impingement surface, thus preventing diminution of its separating effect.

The impingement plate is not subject to any restriction as to shape, number, etc., provided that it is so shaped as to satisfy the aforementioned requirements in the practice of this invention.

Any suitable means may be provided for running the fibrous material against the impingement surface. However, it is preferable to use a jet of a fluid such as air, which also enchances the separation of the fibrous material.

The separating effect may be further enhanced if the method described herein is used in combination with other known separating techniques. Particularly, if the filaments are electrostatically charged by use of an electrifying means before they are impinged upon the impingement surface, a multiple separation effect of great value may be achieved.

Figure 8:
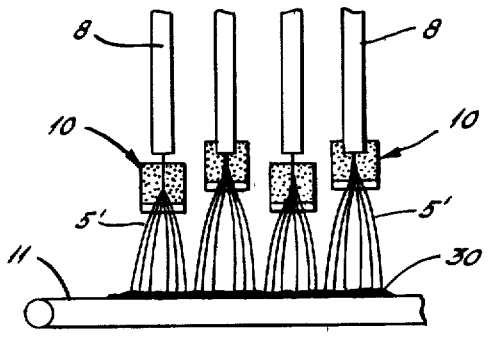
FIG. 8 is a diagrammatic drawing illustrating a zigzag arrangement of impingement plates used in treating a plurality of continuous multifilament fibrous bundles simultaneously.

Another embodiment of the impingement plate is shown in FIG. 8, wherein a front view of the sheet producing process previously described is shown. This embodiment comprises a plurality of nozzles and associated impingement plate units, each unit including a nozzle 8 and an impingement plate 10 for processing the filaments of the fibrous material 5'. To prevent interference as between the filaments of adjacent units, the units are arranged in a zigzag configuration so that the fibrous materials forced out of the respective nozzles will contact the impingement plates at staggered positions. The impingement plates may be set at the same or at different angles of inclination from each other.

Figure 9:
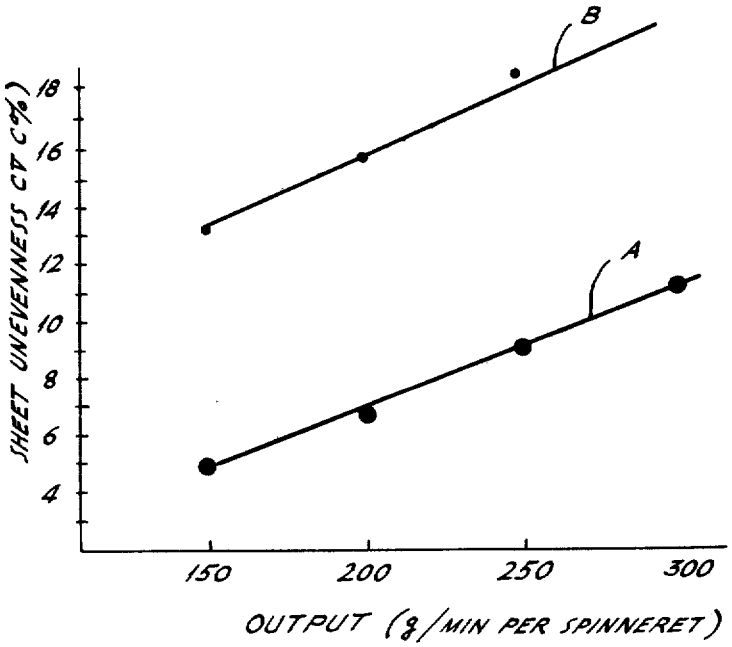
FIG. 9 is a diagram showing the relationship between sheet uniformity and the rate of output of polymer from a spinneret where two different impingement plate materials were used.

FIG. 9 demonstrates typical benefits derived from the use of the material according to this invention. FIG. 9 is a graph showing the relationship between sheet unevenness and output of polymer from the spinneret using two different impingement surfaces. Non-woven sheets were producing using six nozzle and impingement plate units of the type illustrated in FIG. 2. In the tests indicated by the line A, an alloy of 90% lead and 10% antimony was used as the impingement plate surface material. In tests designated by the line B a comparative material, 100% iron, was used as the impingement plate surface material. It is demonstrated in FIG. 9 that when using an impingement plate of this invention, where the impingement surface is a material which produces a negative electrical charge on the filament surface, excellent filament separation occurs and sheet unevenness is markedly reduced when compared to a comparative material at various rates of output from the spinneret.

Sheet unevenness was evaluated by determining the coefficient of variation where weights were taken of 5 cm×5 cm samples, and where the sample size was 400, using the following formula:

$$CV\ (\%) = \frac{\sigma\ \text{(standard deviation)}}{\bar{x}\ \text{(mean value)}} \times 100$$

The present invention is further described by, but is not limited to, the following Examples, which have been selected for the purpose of illustrating specific embodiments.

EXAMPLE 1

By following the process shown in FIG. 1 without using the electrifying device 9, and using six units of nozzles and impingement plates, polethylene terephthalate was extruded from the spinnerets with each spinneret having 66 holes and an output rate of 200 g/min. to obtain a fibrous material with a single filament size of 5 denier and a non-woven sheet was formed. The operating conditions used were:

| | | |
|---|---|---|
| Compressed air jet pressure: | | 2.3 kg/cm² G |
| (Cylinder) Pipes: | diameter: | 7.0 mm |
| | length: | 1,590 mm |
| Filament speed: | | 5,600 m/min |
| Distance between nozzle and impingement plate: | | 40 mm |
| Angle of inclination of impingement plate: | | 60° |
| Dimensions of impingement plate: | width: | 50 mm |
| | length: | 100 mm |
| | thickness: | 10 mm |

The surface composition of the impingement plate was varied and the surface potential, the static charge on the filaments and sheet uniformity were measured. The results are shown in Table 1.

Measurements of the surface potential and evaluation of sheet uniformity were made as described above. The static charge on the filaments was determined according to the Faraday Cage method by using a Static Charge Meter KQ-431 B manufactured by Kasuga Denki KK. The filament surface area was determined using the following formula:

$$\text{Surface area (S)} = \pi \cdot \phi \cdot \text{N.V.}$$

$$\text{where } \phi = 1.01 \times 10^{-5}\sqrt{d}$$

N = the number of filaments
V = filament speed (m/min)
d = denier per filament

Sheet uniformity was also evaluated visually.

EXAMPLE 2

In Level 6 of Example 1, the surface potential dropped from −16 KV to −9 KV after elapsed time of 40 minutes, but the original surface potential was restored when the impingement plate was repositioned so as to change the point of impact of the fibrous material on the impingement plate.

EXAMPLE 3

In Level 1 of Example 1, in order to form a zigzag arrangement of the nozzles and impingement plates of the adjacent units, the nozzles and impingement plates were alternately placed 40 mm and 60 mm apart from each other. This arrangement gave a surface potential of −22 KV using a lead plate impingement surface. Sheets with good uniformity were produced with a coefficient of variation of unevenness of 6.5%.

TABLE 1

| | Materials according to this invention | | | | | |
|---|---|---|---|---|---|---|
| | Level | | | | | |
| | 1 | 2 | 3 | 4 | 5 | 6 |
| | Materials | | | | | |
| Items | Lead plate | Lead (90) antimony (10) | Lead (95) indium (5) | Lead (60) tin (40) | Zinc | Zinc plating |
| Surface Potential (KV) | −22 | −24 | −24 | −18 | −16 | −16 |
| Static charges (coulomb/m²) | $1.7 \times 10^{-5}$ | $1.9 \times 10^{-5}$ | $1.9 \times 10^{-5}$ | $1.4 \times 10^{-5}$ | $1.2 \times 10^{-5}$ | $1.4 \times 10^{-5}$ |
| Sheet unevenness (CV %) | 6.9 | 6.6 | 6.6 | 7.8 | 11.0 | 11.2 |
| Visual evaluation of sheet uniformity | Very excellent | Very excellent | Very excellent | Fairly good | Good | Good |

| | Materials according to this invention | | | | | Comparative materials |
|---|---|---|---|---|---|---|
| | Level | | | | | |
| | 7 | 8 | 9 | 10 | 11 | 12 |
| | Materials | | | | | |

TABLE 1-continued

| Items | Zinc Oxide | Copper | Piezo-electric material | Silver | Aluminum | Lead (50) tin (50) |
|---|---|---|---|---|---|---|
| Surface Potential (KV) | −15 | −15 | −20 | −15 | −10 | −9 |
| Static charges (coulomb/m$^2$) | $1.4 \times 10^{-5}$ | $1.5 \times 10^{-5}$ | $1.6 \times 10^{-5}$ | $1.4 \times 10^{-5}$ | $1.4 \times 10^{-5}$ | $1.0 \times 10^{-5}$ |
| Sheet unevenness (CV %) | 11.5 | 10.8 | 7.5 | 10.3 | 10.0 | 11.5 |
| Visual evaluation of sheet uniformity | Good | Good | Fairly good | Good | Good | Slight unevenness |

| | Comparative materials | | | | | |
|---|---|---|---|---|---|---|
| | Level | | | | | |
| | 13 | 14 | 15 | 16 | 17 | 18 |
| | Materials | | | | | |
| Items | Stainless steel | Glass | Vinyl chloride | PBT* | Iron | Ceramic |
| Surface Potential (KV) | +5 | +2 | +3 | +4 | +6 | +7 |
| Static charges (coulomb/m$^2$) | $0.2 \times 10^{-5}$ | $0.3 \times 10^{-5}$ | $0.2 \times 10^{-5}$ | $0.2 \times 10^{-5}$ | $0.2 \times 10^{-5}$ | $0.1 \times 10^{-5}$ |
| Sheet unevenness (CV %) | 14.5 | 15.0 | 15.8 | 15.3 | 15.8 | 16.5 |
| Visual evaluation of sheet uniformity | Conspicuous unevenness | Conspicuous unevenness | Conspicuous unevenness | Conspicuous unevenness | Conspicuous unevenness | Conspicuous unevenness |

*PBT: Poly Butylen Terephthalate

As in evident from the foregoing descriptions various preferred embodiments of the invention, excellent separation of the filaments of a fibrous material can be achieved, as demonstrated by the production of non-woven sheets of excellent uniformity, by using an impingement plate whose impingement surface is composed of a material which creates a negative electrical charge on the surfaces of the filaments of a fibrous material upon impingement of the fibrous material against the impingement surface.

The present invention is not limited in its application to a sheet producing process but proves effective for separating filament bundles for many types of fibrous products.

What is claimed is:

1. An apparatus for separating filaments in a filament bundle, which comprises a nozzle for ejecting the filament bundle, means for ejecting said filament bundle from said nozzle, an impingement plate having a surface composed of a material that negatively electrically charges the surfaces of the filaments of the fiber bundle upon impact, said plate being positioned adjacent said nozzle so that the filament bundle is projected against said surface of said impingement plate.

2. The apparatus defined in claim 1, wherein the impingement surface comprises a lead-based metal.

3. The apparatus defined in claim 2, wherein the material is principally a lead alloy containing at least 60% by weight of lead.

4. The apparatus defined in claim 1, wherein the material is principally composed of at least one substance selected from the group consisting of zinc and zinc oxide.

5. The apparatus defined in claim 1, wherein the material is principally composed of copper.

6. The apparatus defined in claim 1, wherein the material is principally composed of silver.

7. The apparatus defined in claim 1, wherein the material is principally composed of aluminum.

8. The apparatus defined in claim 1, wherein the material is principally composed of a piezoelectric material.

9. The apparatus defined in claim 1, wherein a plurality of the nozzle units are provided alongside one another, and are arranged with the corresponding impingement plates in a zigzag configuration.

10. The apparatus defined in claim 1, wherein the impingement surface of the impingement plate is movably mounted and is capable of being repositioned.

11. An apparatus for separating the filaments of multiple filament bundles of fibrous material, which comprises multiple units of nozzles constructed and arranged for ejecting the filament bundles, pressure fluid means connected to said nozzles for ejecting said fibrous material from said nozzles, impinging plates adjacent each of said nozzles in positions for impact with the filament bundles ejected by said nozzles, the surfaces of said plates being composed of a material that negatively electrically charges the surfaces of the filaments of the fiber bundles upon impact, said multiple nozzle units being arranged in a zigzag configuration adjacent one another.

* * * * *